US006142113A

United States Patent [19]

Mochizuka et al.

[11] Patent Number: 6,142,113

[45] Date of Patent: Nov. 7, 2000

[54] TWO-CYCLE INTERNAL COMBUSTION ENGINE AND CYLINDER

[75] Inventors: Mitsujiro Mochizuka, Fuchu; Shigeru Taniguchi, Tachikawa; Masami Uchida, Sayama; Shiro Yamaguchi, Ohme; Masayoshi Miyamoto, Hachioji, all of Japan

[73] Assignee: Kioritz Corporation, Tokyo, Japan

[21] Appl. No.: 09/350,154

[22] Filed: Jul. 9, 1999

[30] Foreign Application Priority Data

Jul. 16, 1998 [JP] Japan ..... 10-202075

[51] Int. Cl.[7] ..... F02B 25/16; F02B 25/14

[52] U.S. Cl. ..... 123/65 P; 123/73 PP

[58] Field of Search ..... 123/65 P, 73 PP, 123/65 A, 73 R, 73 BA

[56] References Cited

U.S. PATENT DOCUMENTS

| | | | |
|---|---|---|---|
| 3,382,857 | 5/1968 | Foster et al. | 123/73 R |
| 4,167,160 | 9/1979 | Matsushita et al. | 123/73 PP |
| 4,180,029 | 12/1979 | Onishi | 123/73 PP |
| 4,516,540 | 5/1985 | Nerstrom | 123/65 P |
| 4,598,673 | 7/1986 | Poehlman | 123/73 PP |
| 4,934,345 | 6/1990 | Fukuoka et al. . | |

*Primary Examiner*—M. McMahon

*Attorney, Agent, or Firm*—Michael D. Bednarek; Shawpittman

[57] ABSTRACT

A loop scavenge two-cycle internal combustion engine that includes a partial wall partition disposed between a scavenging path and a cylinder bore, with a cooling port formed in the partial wall partition for enabling fresh gas in the scavenging path to contact directly with a peripheral wall of a piston in the cylinder. The fresh gas in the scavenging path directly contacts and efficiently cools the peripheral surface of the piston to prevent heat rise and distortion within the engine. The partial wall partition and cooling port maximize both cooling efficiently and cylinder strength and durability.

8 Claims, 4 Drawing Sheets

TWO-CYCLE INTERNAL COMBUSTION ENGINE AND CYLINDER

BACKGROUND OF THE INVENTION

1. Field of the Invention

The present invention relates to internal combustion engines, and more particularly, to a loop scavenge two-cycle internal combustion engine and cylinder that use partial wall partitions and cooling ports to cool the cylinder and piston while still maintaining cylinder strength.

2. Description of the Related Art

In conventional two-cycle internal combustion engines using loop scavenge designs, scavenging paths convey compressed air-fuel mixtures from the crank chamber along the wall of the cylinder and into to the top of the cylinder. Typically, these scavenging paths are constructed in one of two ways: with wall partitions or without wall partitions. Designs using wall partitions completely separate scavenging paths from cylinder chambers such that the air-fuel mixture flowing through the scavenging path never contacts the side of the piston. In designs without wall partitions, a scavenging path is a channel formed along the inner wall of the cylinder with a side open to the piston. In this configuration, as the air-fuel mixture flows in the channel it contacts the side of the piston until it is discharged into the top of the cylinder. U.S. Pat. No. 4,934,345 discloses a loop scavenge engine without wall partitions.

The partitioned and non-partitioned designs offer mutually exclusive advantages. Using wall partitions increases cylinder strength and provides a more efficient scavenging operation in comparison to the non-partitioned design. In contrast, omitting the partitioning wall significantly improves cooling efficiency by applying cool fresh gas (air-fuel mixture) directly to the outer peripheral wall surface of the piston. In addition, the absence of partition walls decreases the weight of the engine, a significant advantage for applications requiring the user to move and handle the engine, e.g., chain saws and hedge trimmers. Thus, each design trades off one advantage for another, i.e., strength versus weight and scavenging efficiency versus cooling efficiency.

Therefore, there remains a need for a two-cycle engine loop scavenge system that incorporates all of the advantages of the partitioned and non-partitioned designs. The system should provide a lightweight engine with a strong cylinder that provides efficient scavenging as well as cooling.

SUMMARY OF THE INVENTION

The present invention is a two-cycle internal combustion engine that allows an air-fuel mixture flowing in a scavenging path to contact and cool an adjacent piston wall, while still maintaining cylinder strength and scavenging efficiency. The invention comprises a partial wall partition separating the scavenging path from the piston wall. The partial wall partition contains a cooling port that opens the scavenging path to the piston wall and allows the air-fuel mixture flowing in the scavenging path to both contact and cool the piston wall. The cooling port efficiently cools the piston, limits the temperature rise of the cylinder, prevents heat damage to the piston and cylinder, and improves the durability of the engine. Moreover, using a partial wall partition facilitates cooling through the cooling port while still maintaining a strong cylinder structure.

In the preferred embodiment of the present invention, the cooling port is located both to accommodate fabrication by casting and to maximize cooling of the piston. To ease fabrication, the lower edge of the cooling port corresponds with the lower edge of the open side of the cylinder. In this location, the cooling port follows the mold-releasing direction of the cylinder and permits easy removal of the mold after casting the cylinder.

To maximize cooling efficiency, the cooling port is located adjacent to the exhaust outlet of the cylinder. The area surrounding the exhaust outlet typically absorbs more heat than other engine locations because of the exiting high temperature combustion gases. Thus, positioning the cooling port over this high temperature area efficiently cools the exhaust outlet, the cylinder, and the piston.

In addition to the partial wall partition, in the preferred embodiment of the present invention, a bridge part provides structural support between the bottom edge of the scavenging ports and the top of the partial wall partition. By strengthening the cylinder wall, the bridge part protects the cylinder from heat distortion and improves the durability of the cylinder assembly. In addition, the bridge part also controls the direction of scavenging, effectively preventing a blow-by of the air-fuel mixture to the exhaust outlet, and consequently, improving emission qualities.

Accordingly, it is an object. of the present invention to provide a loop scavenge two-cycle internal combustion engine that excels in scavenging efficiency and cooling performance, without reducing cylinder strength.

This and other objects of the present invention are described in greater detail in the detailed description of the invention, the appended drawings and the attached claims.

DESCRIPTION OF THE PREFERRED EMBODIMENT

Figure 1:
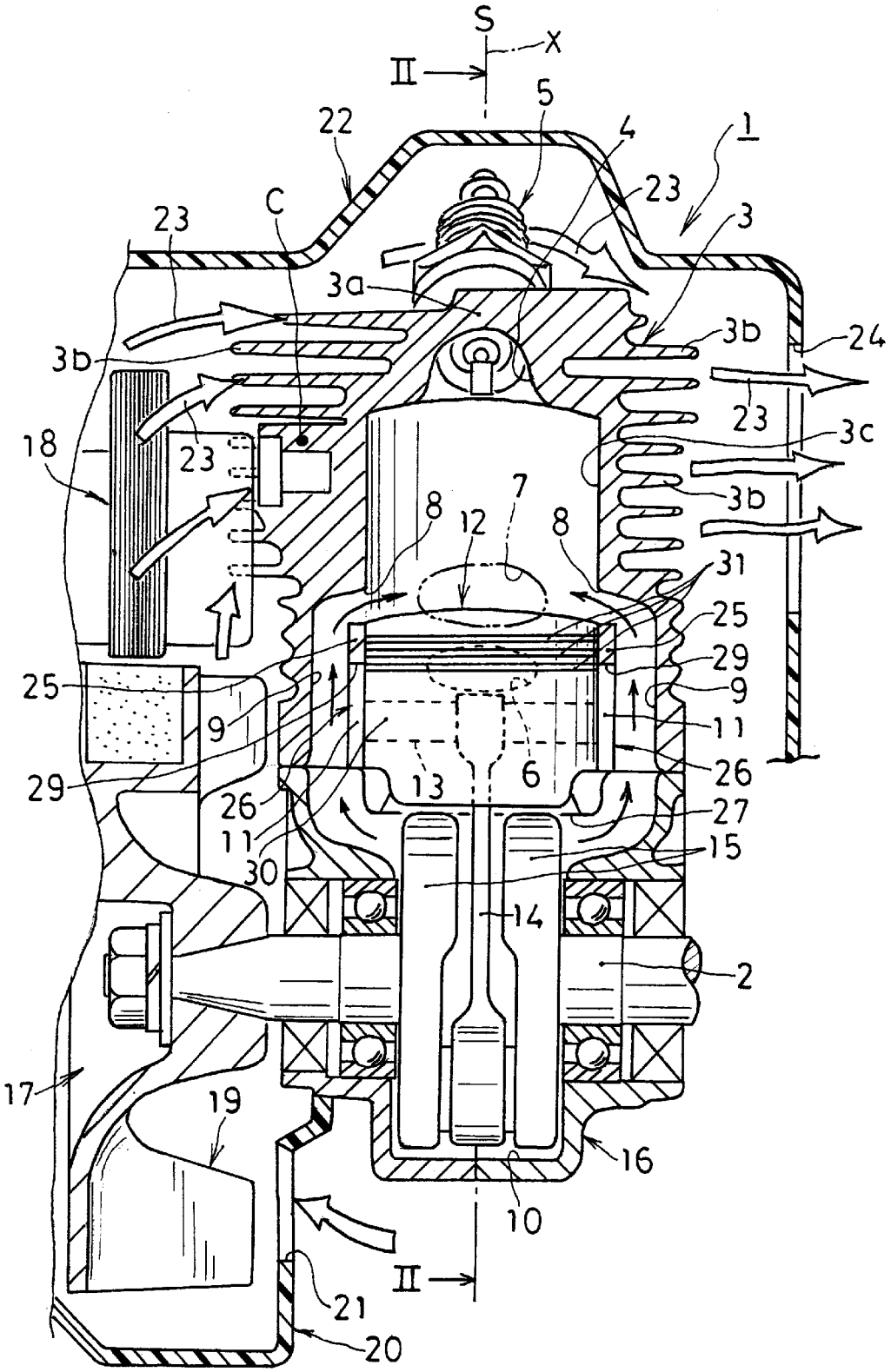
FIG. 1 is a sectional view of a two-cycle internal combustion engine along the axis of the crankshaft according to the present invention.

Referring to FIG. 1, the preferred embodiment of the present invention is a small, loop scavenge air-cooled two-cycle gasoline engine (hereinafter referred to as an internal combustion engine), having a piston displacement on the order of 15 to 35 cubic centimeters. Such engines are typically used in a wide variety of hand-held power tools, e.g., chainsaws, brushcutters, and concrete saws.

The central component of the internal combustion engine 1 is a cylinder 3, having a cylinder head 3*a* at its top and a plurality of cooling fins 3*b* integrally formed on its periphery. Just below the cylinder head 3*a*, the cylinder 3 contains a combustion chamber 4. A spark plug 5 sits diagonally through the cylinder head 3*a*, with the tip of the spark plug 5 extending into the combustion chamber 4. Below the combustion chamber 4, a suction inlet 6 and an exhaust outlet 7 are located in opposing walls of the cylinder 3, with the exhaust outlet 7 positioned laterally above the suction inlet 6. The suction inlet 6 communicates with a carburetor and the exhaust outlet 7 communicates with an exhaust muffler, each in a conventional manner (the carburetor and exhaust muffler are not shown). Through the walls of the cylinder 3, a pair of scavenging ports 8 is symmetrically arranged with respect to a longitudinal sectional center plane S. The pair of scavenging ports 8 fluidly connect to a crank chamber 10 through a pair of scavenging paths 9 symmetrically disposed with respect to the longitudinal sectional center plane S. A pair of partial wall partitions 11 is disposed symmetrically with respect to the longitudinal sectional center plane S, so as to partition the pair of scavenging paths 9 from a bore 3*c* of the cylinder 3.

The bore 3*c* of the cylinder 3 receives a piston 12. Guided by the bore 3*c*, the piston 12 slides in reciprocating motion along a vertical axis X. As the piston 12 slides within the bore 3*c*, the wall of the piston 12 sequentially open and close the suction inlet 6, the exhaust outlet 7, and the pair of scavenging ports 8, in what is typically referred to as a piston valve type operation. A piston pin 13 and a connecting rod 14 convey the reciprocating motion of the piston 12 to a crankshaft 2, where the reciprocating motion is converted to rotational motion of the crankshaft 2. To enable this rotation, the crankshaft 2 is equipped with a pair of balance weights 15. The crankshaft 2 rotates in a crankcase 16 that is connected to the bottom of the cylinder 3 and forms the crank chamber 10 therein. The brake power generated by the rotational motion of the crankshaft 2 can be coupled to a centrifugal clutch (not shown) to actuate a hand-held power tool.

A magneto rotor 17 is mechanically connected to an end (the left end in FIG. 1) of the crankshaft 2. The rotation of the crankshaft 2 drives the magneto rotor 17, which then electrically powers the spark plug 5 to generate discharge sparks in cooperation with an ignition coil 18.

For air cooling, the internal combustion engine 1 uses a centrifugal cooling fan 19 to drive a constant airflow around the cylinder 3. The cylinder 3 is contained in an engine case 22 and a cooling fan cover 20. A centrifugal cooling fan 19, which is integrally formed with the magneto rotor 17, draws fresh air through a cooling air intake port 21 in the cooling fan cover 20 and generates cooling airflows 23 within the engine case 22. The cooling airflows 23 pass along the inner surface of the engine case 22, around the cylinder 3, and out through an air outlet port 24 in the engine case 22. As the cooling airflows 23 pass through the cooling fins 3*b*, the internal combustion engine 1 cools.

Figure 2:
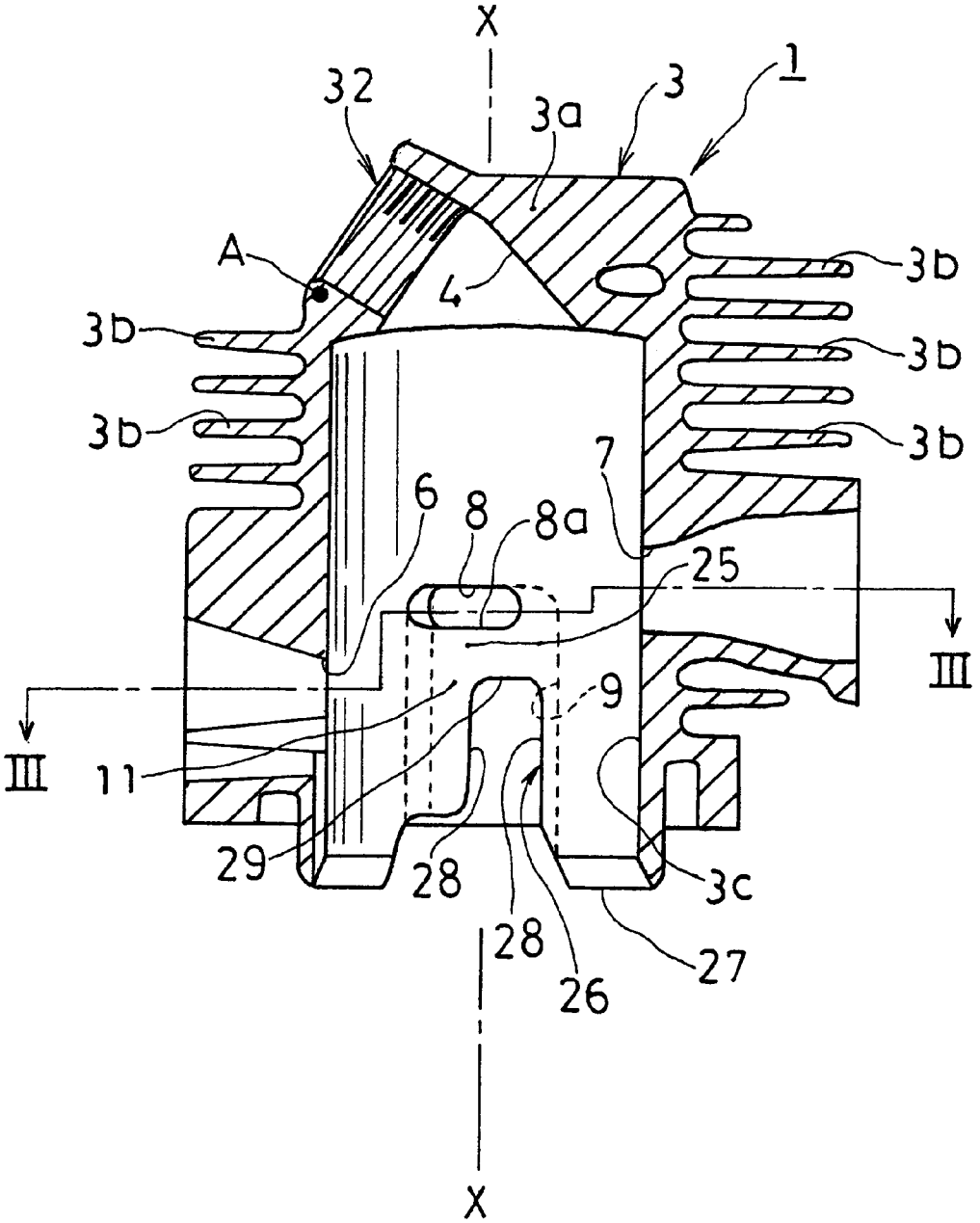
FIG. 2 is a sectional view of the engine shown in FIG. 1 along line II—II of FIG. 1.

Referring to FIG. 2, the pair of partial wall partitions 11 is symmetrically positioned along opposing sides of the cylinder 3. To simplify discussion of FIG. 2, only one side of the cylinder will be described, with the understanding that the other side is symmetrically identical. The partial wall partition 11 resists heat distortion of the cylinder 3, maintains cylinder strength, and provides means of scavenging through the scavenging port 8. The bridge part 25 defines a lower edge 8*a* of the scavenging port 8 and spans the width of the scavenging path 9 to maintain the structural rigidity of the cylinder 3. Formed in the partial wall partition 11 is the cooling port 26. This cooling port 26 fluidly connects the scavenging path 9 to the cylinder bore 3*c*. The cooling port 26 extends from the bridge part 25 to the bottom of the cylinder 3. The cooling port 26 is defined by a pair of parallel vertical edges 28 extending along the vertical axis X down to a lower open-side peripheral edge 27 of the cylinder 3, and by an upper horizontal edge 29 connecting the upper ends of the pair of vertical edges 28 with each other. The cooling port 26 directly cools the outer surface of the piston 12 with the fresh air-fuel mixture passing through the scavenging path 9. To optimize scavenging efficiency, cooling efficiency, and cylinder strength, the size of the cooling port 26 must be large enough to accommodate scavenging and cooling, yet small enough to maintain the structural integrity of the partial wall partition 11.

For example, in the present embodiment, the internal combustion engine 1 has a cylinder bore of 34 mm, a piston stroke of 28 mm, displacement of 25.4 cubic centimeters and the cooling point Z6 shares 30% or more of the bore wall area of the scavenging path 9.

The scavenging and cooling process works as follows. As shown in FIG. 1, a skirt portion 30 of the piston 12 is first exposed to the scavenging path 9 through the cooling port 26 as the piston 12 descends from the top of the cylinder bore 3*c*. When the piston 12 reaches the bottom dead center of its stroke, the largest area of the skirt portion 30 is exposed to the air-fuel mixture in the scavenging path 9. With the piston 12 at the bottom dead center, the air-fuel mixture is compressed in the crank chamber 10 and conveyed through the scavenging path 9. As the air-fuel mixture flows through the scavenging path 9, it cools the large, exposed outer surface area of the skirt portion 30 through the cooling port 26. Therefore, the fresh gas cools the skirt portion 30 of the piston 12, piston rings 31 in contact with the piston 12, and the cylinder 3 in contact with the piston 12 and piston rings 31.

In the preferred embodiment of the present invention shown in FIG. 2, to maximize cooling efficiency, the cooling port 26 is disposed on the side of cylinder 3 closest to the exhaust outlet 7, where the vertical axis X defines two sides of the cylinder 3 from the perspective shown in FIG. 2. Generally, the engine temperature is higher around the exhaust outlet of a cylinder because of exiting high temperature combustion gases. Thus, applying the cooling air-fuel mixture flow in the area of the exhaust outlet 7 reduces the heat concentration and prevents heat transfer to other engine locations. Specifically, positioning the cooling port 26 nearest the exhaust outlet 7 cools the area of the skirt portion 30 of the piston 12 closest to the exhaust outlet 7, which in turn cools the proximate piston rings 31 and the adjacent area of the cylinder 3. The end result is the more efficient cooling of the internal combustion engine 1 as a whole.

Figure 3:
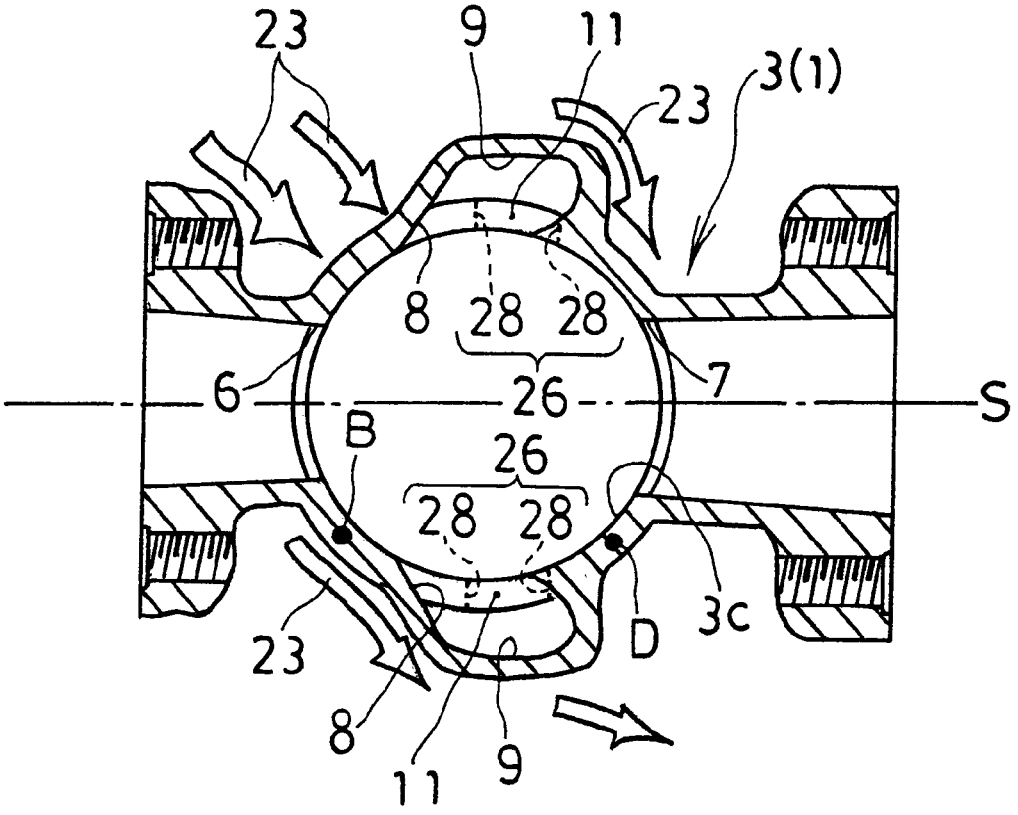
FIG. 3 is a transverse sectional view of the engine shown in FIG. 2 along line III—III.

The heat concentration around the exhaust outlet 7 is further compounded by the direction of the cooling airflows 23. As shown in FIG. 3, typically the cooling airflows 23 are divided into a portion flowing to the suction inlet 6 side and another portion flowing to the exhaust outlet 7 side. Therefore, the cooling effect from the outside of the cylinder 3 by the cooling fan 19 is likely to be insufficient at the exhaust outlet 7 side. Thus, air-fuel mixture cooling supplied by the cooling port 26 at the exhaust outlet 7 compensates for the insufficient forced air cooling on the outside of the cylinder 3.

In the preferred embodiment of the present invention, the cooling port 26 is located to facilitate mold releasing after the cylinder 3 is caste, e.g., in an aluminum die-casting operation. For example, as shown in FIG. 2, the cooling port 26 is defined by the pair of vertical edges 28 extending along the vertical axis X of the cylinder 3 down to the lower open-side peripheral edge 27 of the cylinder 3. This configuration facilitates mold releasing along the vertical axis X of the cylinder 3.

Figure 4:
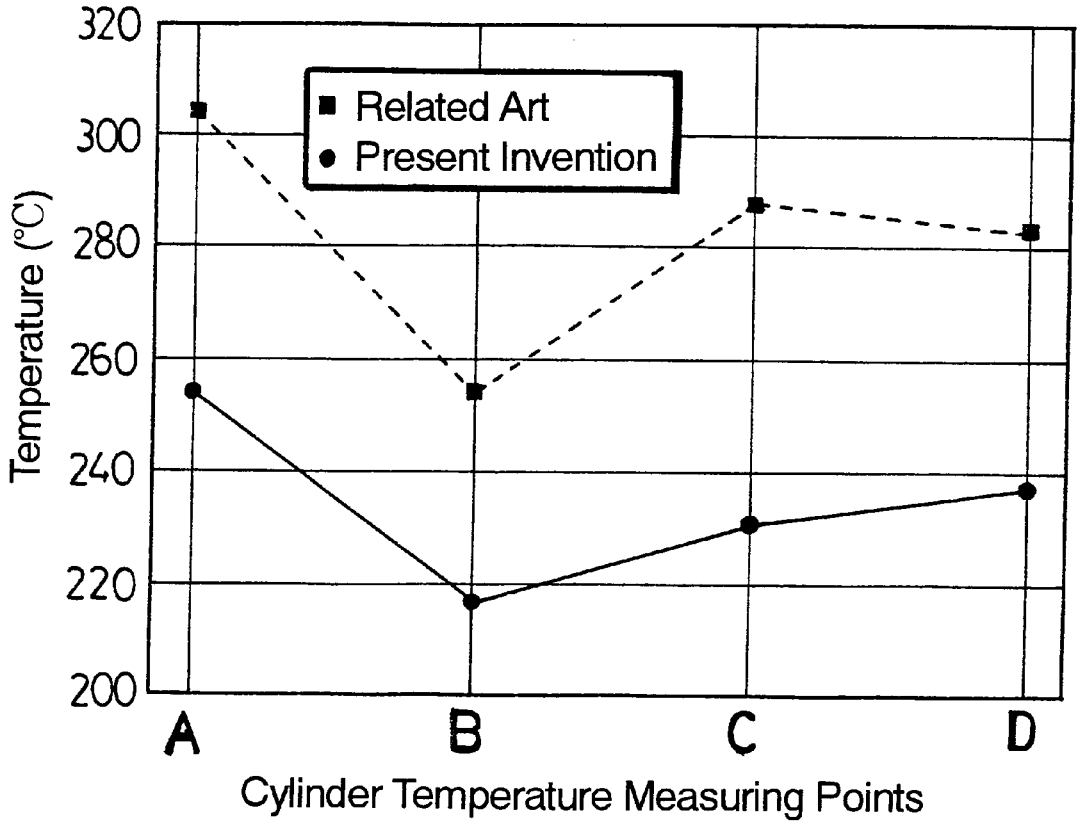
FIG. 4 is a graph comparing the operating temperatures of an internal combustion engine of the present invention with the operating temperatures of a conventional internal combustion engine.

In the preferred embodiment of the present invention, the pair of partial wall partitions 11 and the pair of cooling ports 26 significantly reduce heat distortion of the piston 12 and cylinder 3, while still maintaining cylinder strength and durability. To quantify the cooling effect, FIG. 4 compares the operating temperature of the internal combustion engine 1 of the preferred embodiment of the present invention with the operating temperature of a conventional loop scavenge engine, which is the same as the preferred embodiment except that it has a complete wall partition dividing the scavenging path from the cylinder chamber (namely, cooling port share is zero.) The temperatures of the two engines were measured under identical operating conditions at the following four points: point A at a plug seat 32 of the cylinder 3 (as indicated in FIG. 2); point B between the suction inlet 6 and the scavenging port 8 of the cylinder 3 (as indicated in FIG. 3); point C in the upper area of the scavenging path 9 of the cylinder 3 (as indicated in FIG. 1); and, point D between the scavenging port 8 and the exhaust outlet 7 of the cylinder 3 (as indicated in FIG. 3). As shown in FIG. 4, the operating temperatures of the present invention at all measuring points were below that of the conventional engine by approximately 40 to 50 degrees.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What is claimed is:

1. A two-cycle internal combustion engine comprising:

(a) a crankcase;

(b) a piston mounted on a connecting rod supporting said piston for reciprocating movement, said connecting rod being mounted on a crankshaft rotatable in said crankcase; and (c) a cylinder comprising:

(i) a cylinder bore receiving said piston;

(ii) a suction inlet formed in an inner wall of the cylinder;

(iii) an exhaust outlet formed in an inner wall of the cylinder opposite the suction inlet;

(iv) at least one scavenging path formed in an inner wall of the cylinder that fluidly connects to the crankcase;

(v) at least one scavenging port that fluidly connects the at least one scavenging path to the cylinder bore;

(vi) a bridge part disposed below the at least one scavenging port and spanning the scavenging path, wherein an upper edge of the bridge part defines a lower edge of the at least one scavenging port;

(vii) at least one partial wall partition that separates the at least one scavenging path from the cylinder bore, wherein a lower edge of the bridge part defines a top edge of the at least one partial wall partition; and (viii) at least one cooling port disposed in the partial wall partition, said at least one cooling port fluidly connected to the cylinder bore and the piston, and wherein-said at least one cooling port enables gas in said at least one scavenging path to contact the piston in said cylinder bore.

2. The two-cycle internal combustion engine of claim 1, wherein a perimeter of said at least one cooling port is defined by a line of a lower edge of the bridge part, a longitudinal line of the cylinder extending along a casting mold-release direction, a line parallel to the longitudinal line of the cylinder extending along a casting mold-release direction, and a line corresponding to an open-side peripheral edge of said cylinder.

3. A two-cycle internal combustion engine of claim 1, wherein said at least one cooling port is disposed adjacent to the exhaust outlet of said cylinder.

4. The two-cycle internal combustion engine of claim 1, wherein the at least one scavenging path has a predetermined width and said at least one partial wall partition covers approximately 50% of the width of the at least one scavenging path.

5. A cylinder for a two-cycle internal combustion engine with a reciprocating piston sliding in a bore of the cylinder, a suction inlet, and an exhaust outlet comprising:

(a) a scavenging path formed in an inner wall of the cylinder, said scavenging path having a predetermined width;

(b) a scavenging port fluidly connecting the scavenging path to the bore;

(c) a bridge part defining a bottom edge of the scavenging port and spanning the width of the scavenging path;

(d) a partial wall partition disposed between a scavenging path and said cylinder bore and connected to a bottom edge of the bridge part; and (e) a cooling port disposed in said partial wall partition, said cooling port fluidly connected to the cylinder bore and the reciprocating piston such that gas flowing in said scavenging path contacts said reciprocating piston.

6. The cylinder for a two-cycle internal combustion engine of claim 5, wherein a perimeter of said cooling port is defined by a line of a lower edge of the bridge part, a longitudinal line of the cylinder extending along a casting mold-release direction, a line parallel to the longitudinal line of the cylinder extending along a casting mold-release direction, and a line corresponding to an open-side peripheral edge of said cylinder.

7. The cylinder for a two-cycle internal combustion engine of claim 5, wherein said cooling port is disposed adjacent to the exhaust outlet of said cylinder.

8. A method for cooling a loop scavenge two-cycle internal combustion engine with a cylinder having a scavenging path, a cylinder bore, and a piston in the cylinder bore comprising the steps of:

(a) constructing a partial wall partition between the scavenging path and the cylinder bore that covers only a portion of the scavenging path;

(b) strengthening the cylinder by forming a bridge part that spans the scavenging path just below a point where the scavenging path enters the cylinder bore;

(c) forming a cooling port in the partial wall partition to allow a gas in the scavenging path to reach the cylinder bore and contact the piston;

(d) starting the loop scavenge two-cycle internal combustion engine to actuate the piston and move the gas; and (e) cooling the cylinder bore and the piston with the gas flowing through the scavenging path and the cooling port.

* * * * *